United States Patent [19]

Gomi et al.

[11] Patent Number: 4,800,369

[45] Date of Patent: Jan. 24, 1989

[54] ANTI-SHOPLIFTING SYSTEM

[76] Inventors: Toyoji Gomi, No. 29-2, 2-chome, Sasazuka, Shibuya-ku, Tokyo; Kozo Yamada, No. 18-32, 2-chome, Tokumaru, Itabashi-ku, Tokyo, both of Japan

[21] Appl. No.: 918,919

[22] Filed: Oct. 15, 1986

[51] Int. Cl.[4] ..... G08B 13/18

[52] U.S. Cl. ..... 340/572; 340/571

[58] Field of Search ..... 340/572, 571

[56] References Cited

U.S. PATENT DOCUMENTS

| | | | |
|---|---|---|---|
| 3,493,955 | 2/1970 | Minasy | 340/572 |
| 3,713,133 | 1/1973 | Nathans | 340/572 |
| 4,211,995 | 7/1980 | Smith | 340/571 |

*Primary Examiner*—Glen R. Swann, III

*Attorney, Agent, or Firm*—Fleit, Jacobson, Cohn & Price

[57] ABSTRACT

Anti-shoplifting system comprising a switching circuit, a signal generator, and a detector gate. Said switching circuit has a built-in flat-shaped miniature power pack which is attached to individual goods sold in shops and switches on and maintains the circuit of said power pack switched on under the action of external radiowaves. The signal generator consists of a built-in signal-transmitting circuit for transmitting radio signals of a specific frequency from said power supply. The detector gate is provided with a signal-generating state forming a weak radiowave area of the required frequency to energize the switching circuit of said signal generator and receives the radiowaves transmitted from said signal generator so as to drive an alarm device via said received signals.

4 Claims, 6 Drawing Sheets

ANTI-SHOPLIFTING SYSTEM

BACKGROUND OF THE INVENTION

This present invention relates to an anti-shoplifting system designed to prevent theft of goods displayed in shops by drawing on communication and signal technology so that it falls under the international classifications for the patenting of inventions G08B21/00, G08B25/00, H04B/00, and H04B7/00.

The anti-shoplifting systems conventionally used as theft-preventing systems for shop goods have been designed so that a miniature signal generator is attached to the shop goods and an alarm is generated on passing through a detector gate, or alternatively these have been designed so that a modulated signal output is produced by generating a radiowave atmosphere around the detector gate by means of a miniature received-signal modulator attached to the shop goods in such a way that the gate detector unit will cause an alarm to be generated when picking up the signal output of this radiowave.

However, the former type of anti-shoplifting systems present difficulties in that the batteries used for the power pack of the miniature signal generator attached to the shop goods have a short life and require significant maintenance costs associated with the replacement of batteries so that these device are currently not fit for use.

The latter-named devices have the disadvantage that the alarm output is limited to the gate equipment so that it is not possible to identify the shoplifter from amongst a multitude of persons passing through the detector gate, thus giving rise to problems of infringement upon human rights so that these devices are not adequately effective.

A further problem is that the effectiveness of these types of anti-shoplifting systems is completely lost when the unit attached to the shop goods is removed.

SUMMARY OF THE INVENTION

This present invention is designed to overcome the problems described above and its primary purpose is to achieve an anti-shoplifting system capable of generating a theft-detection alarm and of identifying the thief (shoplifter).

A further purpose of this invention is to achieve an anti-shoplifting system characterized by a low power requirement by reducing maintenance and supervision costs through the use of a design whereby the battery of the unit attached to the shop goods is depleted only while shoplifting takes place.

Another purpose of the invention is to achieve an anti-shoplifting system operating also when the unit has been removed from the shop goods.

In order to realize these aims, the technological prerequisite to ensure that the batteries are depleted only while shoplifting is taking place was the development of a parallel wound coil, and this invention therefore tries to achieve its purpose with a device fitted with said coil.

In order to realize the above aims, the anti-shoplifting system of this invention consists of a signal generator presenting the appearance of a product-advertising sticker such as a label or price tag attached to the individual shop goods and detector gates located in the appropriate locations of the shop and capable of switching the said signal generator on while said signal generator passes through these gates and a stage giving a warning that such passage has been detected and a portable signal receiver to detect the signal generated from said signal generator.

For this purpose, said signal generator has a built-in power pack consisting, for example, of a battery. It also has a built-in switching circuit that energizes the power supply circuit on receiving the weak radiowave of the given frequency and maintains it switched on. Furthermore, it is provided with a built-in oscillation circuit, modulation circuit, and signal-transmitting circuit to generate radiowaves of the given frequency when power is supplied from said power supply circuit. It is designed so that the initial driving power of the switching element in said switching circuit is obtained through a multiplicity of parallel wound coils.

Said parallel wound coils represent a special construction consisting of two or more coils formed by winding a single conductor wire once or several times and aligned in parallel in the direction of winding.

Said parallel wound coils can provide a current capable of driving the transistor elements in the switching circuit at both ends of the coils in the weak radiowave range up to 0.5 W.

In this kind of anti-shoplifting system, the power supply circuit is switched on and maintained switched on by the radiowave generated by the appropriate gate as the signal generator passes through that gate. Therefore, the built-in power supply provided from the power supply circuit ensures the continued generation of radiowaves of the prescribed frequency from a built-in miniature antenna via the signal-generating circuit, modulation circuit, and signal-transmitting circuit.

The receiving stage receiving the radiowaves thus generated is provided with said detector gate and portable receiver. This received signal is utilized by the detector gate to signal a "detection" warning to the alarm unit mounted in the gate and in the desired position. Thus, as the portable receiver approaches the person passing through the gate while a "detection" warning is being signalled, it is possible to receive a radiowave signal from the signal generator so as to enable the shoplifting thief to be identified.

Moreover, said signal generator comprises an attachment string formed by making the part of the switching circuit which drives the oscillator circuit when it is released protrude from the body of the unit. That is to say, it is also possible to devise a double switching circuit system in which the first or primary switching circuit switches the power circuit on and maintains it energized under the action of the radiowave band generated by said gate and the secondary switching circuit that switches the corresponding power circuit on and maintains it energized as this switching circuit is released by cutting the attachment string.

Anti-shoplifting systems embodying this inventions are explained in fuller detail in the drawings.

DESCRIPTION OF PREFERABLE EMBODIMENTS

(FIRST EMBODIMENT)

FIGS. 1–4 show the first embodiment of this invention.

Figure 1:
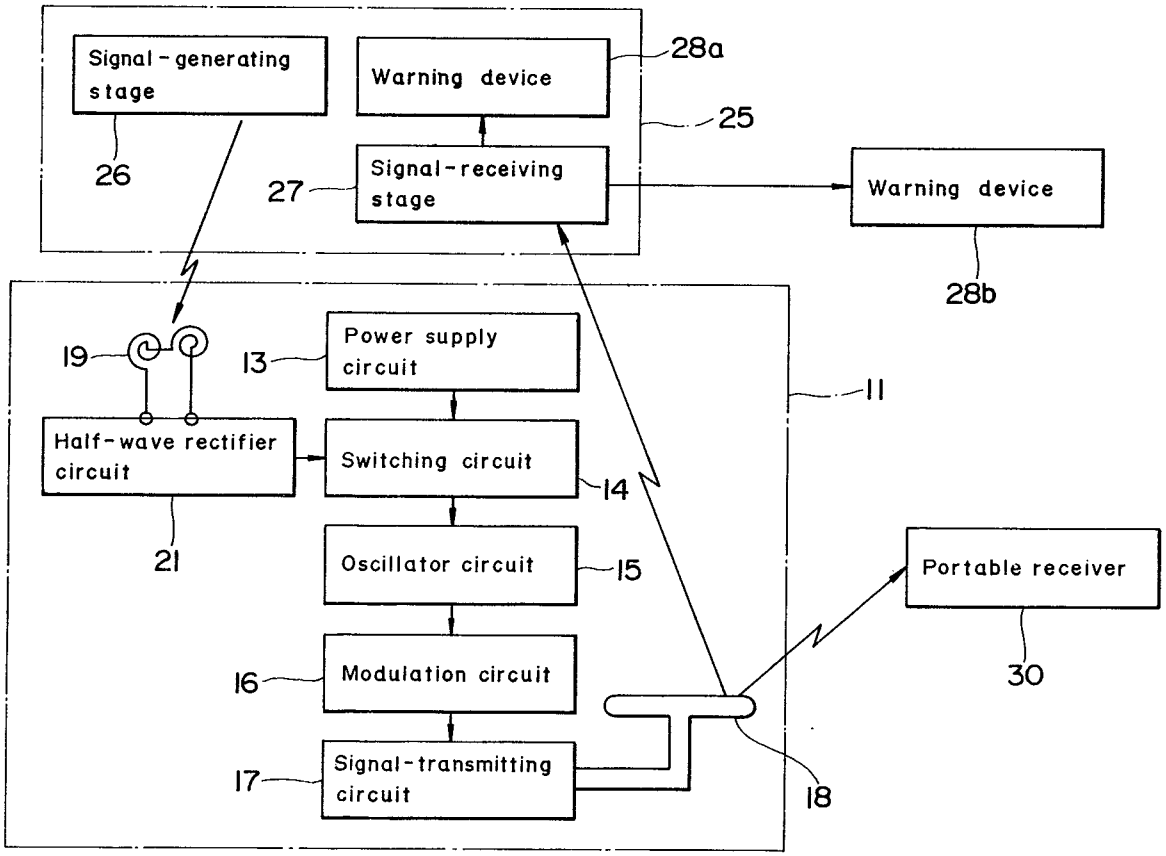
FIG. 1 is a block diagram of the first embodiment of the present invention.
Figure 2:
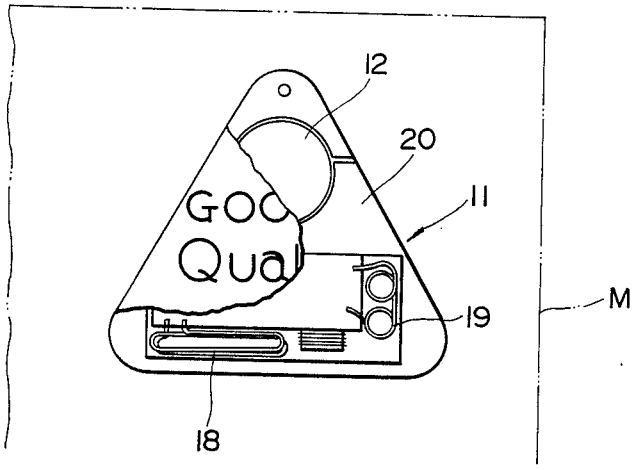
FIG. 2 is a front view showing the same signal generator with a part cut out.
Figure 3:
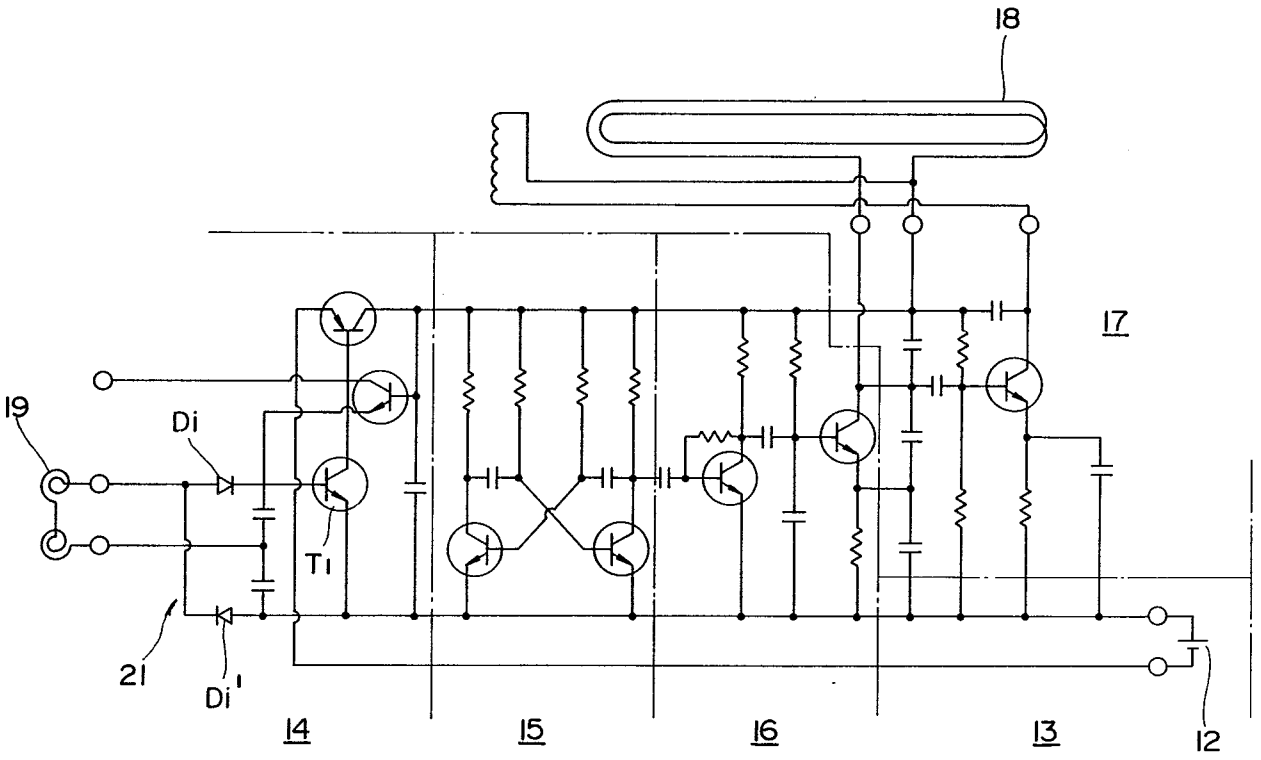
FIG. 3 is a circuit diagram of the same signal generator.

As shown in FIG. 2, signal generator 11 attached to the merchandise M consists of a flat-shell body 20, for example, a card or sheet, of the desired shape, for example, triangular or rectangular. The front and reverse surfaces of this signal generator present the appearance of an advertising or printed display label to conceal the fact that this is signal generator 11. Provided in said shell body 20 are built-in miniature batteries 12, for example, button-type batteries. As shown in FIG. 3, said signal generator 11 comprises a switching circuit 14 which switches the power circuit 13 on in the weak radiowave range of a specific frequency and which, consequent upon this action, maintains the circuit switched on while receiving power from the power supply circuit 13. The item marked 15 is an oscillator circuit generating oscillations of the prescribed frequency while receiving power from the miniature batteries of said power supply circuit 13. The item marked 16 is a modulation circuit modulating the frequency of said oscillations to obtain radiowave signals of the prescribed frequency. The item marked 17 is a signal-transmitting circuit for wireless transmission of said modulated signals. Also implanted in the shell body 20 is signal-transmitting antenna 18. The base current of transistor T1 as the corresponding switching element of said switching circuit 14 should be obtained from the magnetic-field current generated in parallel wound coils 19 and the connection is achieved via a half-wave rectifier 21 composed of two diodes Di and Di'.

Figure 4A:
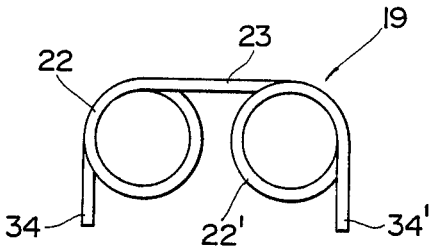
FIG. 4(*a*) is a front view of the parallel wound coil, (*b*) a plane view drawing of same, and (*c*) a side view drawing showing the right side of same.
Figure 4C:
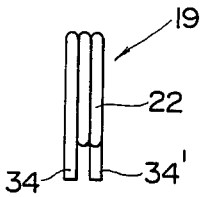
Figure 4B:
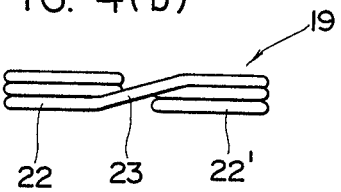

As illustrated in FIG. 4 said parallel wound coil 19 consists of two coils 22 and 22' aligned in parallel via a connecting section 23 in the direction of winding in the shape of spectacles and are formed by winding a single conductor wire of specified length once or several times each.

Moreover, detector gate 25 is comprised of a radiowave-generating stage 26 based on familiar technology to generate only in the prescribed range a weak radiowave (up to 1.5 W) in the resonance frequency range of said parallel wound coil 19, a receiver stage based on familiar technology to receive the radiowaves generated by said signal generator 11, and of warning devices **28*a* and 28*b*** providing the warning signals on receipt of said received signals.

Item marked 30 is a portable receiver with a built-in signal-receiving stage based on familiar technology to receive the radiowaves generated by said signal generator 11.

The anti-shoplifting system designed as described above is used in such a manner that the detector gate 25 is mounted at, or in the vicinity of, the entrance or exit of the shop and the entrance and exit of the shop are sealed off with the radiowave range while the signal generator 11 is attached to the merchandise M. In the event that an ordinary transaction has taken place the shop assistant takes the signal generator 11 off. However, in the event that a theft has occurred and the signal generator 11 comes within a predetermined range of the detector gate 25 by passing through the detector gate 25 while still attached to the merchandise M, the parallel wound coil 19 picks up the weak radiowave through the signal-generating stage 26 of detector gate 25 and produces a magnetic field current at both coil ends. This therefore causes transistor T1 of switching circuit 14 to be energized (ON) to generate a radiowave of the prescribed frequency from the signal-transmitting antenna 18 via oscillator circuit 15, modulation circuit 16, and signal-transmitting circuit 17 by means of the power supplied from the built-in miniature battery 12.

Receiving of this radiowave signal by receiver stage 27 of detector gate 25 will result in warning devices **28*a* and 28*b* producing an acoustic alarm or a flash-light alarm to warn that the signal generator 11 has passed through detector gate 25**.

This warning enables the shop assistant to recognize that a shoplifting thief has passed through detector gate 25.

However, in the event that a multitude of persons has passed through detector gate 25 at that time, it will be possible to identify the thief by a tone having the sound of "BOO" or similar sound being generated when approaching the portable receiver 30 after said portable receiver 30 picks up the radiowave signal from the signal generator 11.

Figure 5:
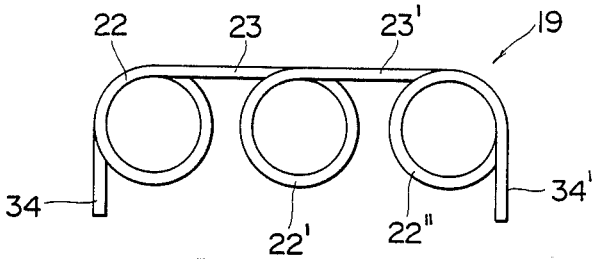
FIG. 5 is a front view showing another embodiment of the parallel wound coil.
Figure 6:
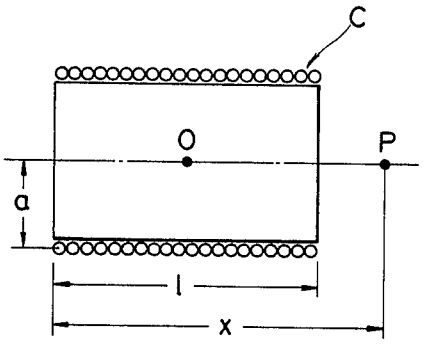
FIG. 6 is an explanatory drawing of a single cylindrically shaped solenoid.

FIGS. 4–6 illustrate the operating principle of said parallel wound coil 19.

The relationship between the single cylindrically shaped solenoid C shown in FIG. 6 and the magnetic field strength H (AT/m) for the coils that have been used so far, including transmitter and receiver coils, is such that the field strength H x at point P located on the coil axis at a distance z (m) from one end of the coil is given by the following formula:

$$Hx = \frac{NI}{2l}\left(\frac{x}{\sqrt{a^2+x^2}} + \frac{1-X}{\sqrt{a^2+(1-x)^2}}\right)(AT/m) \quad (1)$$

if a current I (A) flows through a densely wound single cylindrically shaped coil of diameter a (m), length l (m) and with a total number of windings N. If, however, the value for x in equation (1) is taken as x=l/2, it follows that the magnetic field strength Ho in the center 0 of this solenoid C will be:

$$Ho = \frac{NI}{\sqrt{l^2+4a^2}}$$

If the value for x in equation (1) is taken as x=0, it follows that the magnetic field strength He at the end of the solenoid is $$He = \tfrac{1}{2}\cdot\frac{NI}{\sqrt{l^2+x^2}}$$

Consequently, if the solenoid is sufficiently long so that l>>a, it follows that:

$$Ho = \frac{NI}{l} \ (AT/m)$$

Substituting the number of windings of unit length n=N/l gives:

$$H\ o = n\ I\ (AT/m)$$

This means that the current passing through the coil with solenoid C placed in a constant magnetic field H (AT/m) is:

$$I = H/n\ (A)$$

so that in order to achieve a large current I (A) it will be necessary to use the smallest possible number of windings of unit length n=N/l and it will be essential to use a large-diameter wire for the coil.

However, to achieve a card or sheet format, a flat-shaped coil is used capable of producing a high current value in the weak magnetic field area.

The parallel wound coil in the shape of spectacles as shown by the item marked 19 is obtained by aligning, in the direction of winding, two coils 22 and 22' in a parallel row produced by winding a single conductor wire once or several times each, having a connecting section 23 between them, with the two ends of the winding forming the ends of the coil 34 and 34'. The two coils 22 and 22' are thus wound in the same direction.

FIG. 5 shows another version of the parallel wound coil 19, with three coils 22'' in a row adjacent to each other and connected by the connecting sections 23 and 23' so that the ends of the winding coming out from the terminal coils 22 and 22'' form the coil ends 34 and 34'.

(SECOND EMBODIMENT)

Figure 8:
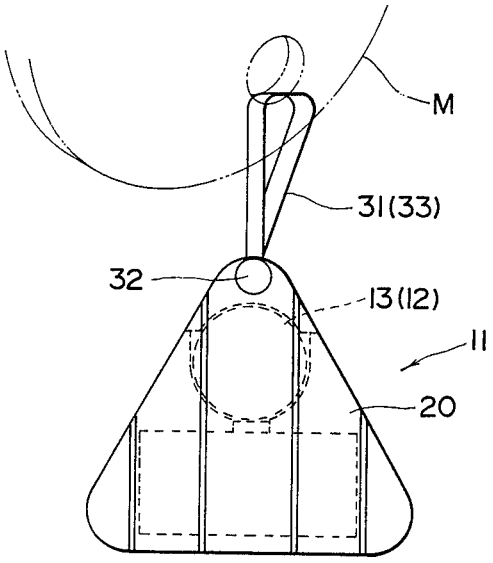
FIG. 8 is a front view showing the same signal generator.
Figure 7:
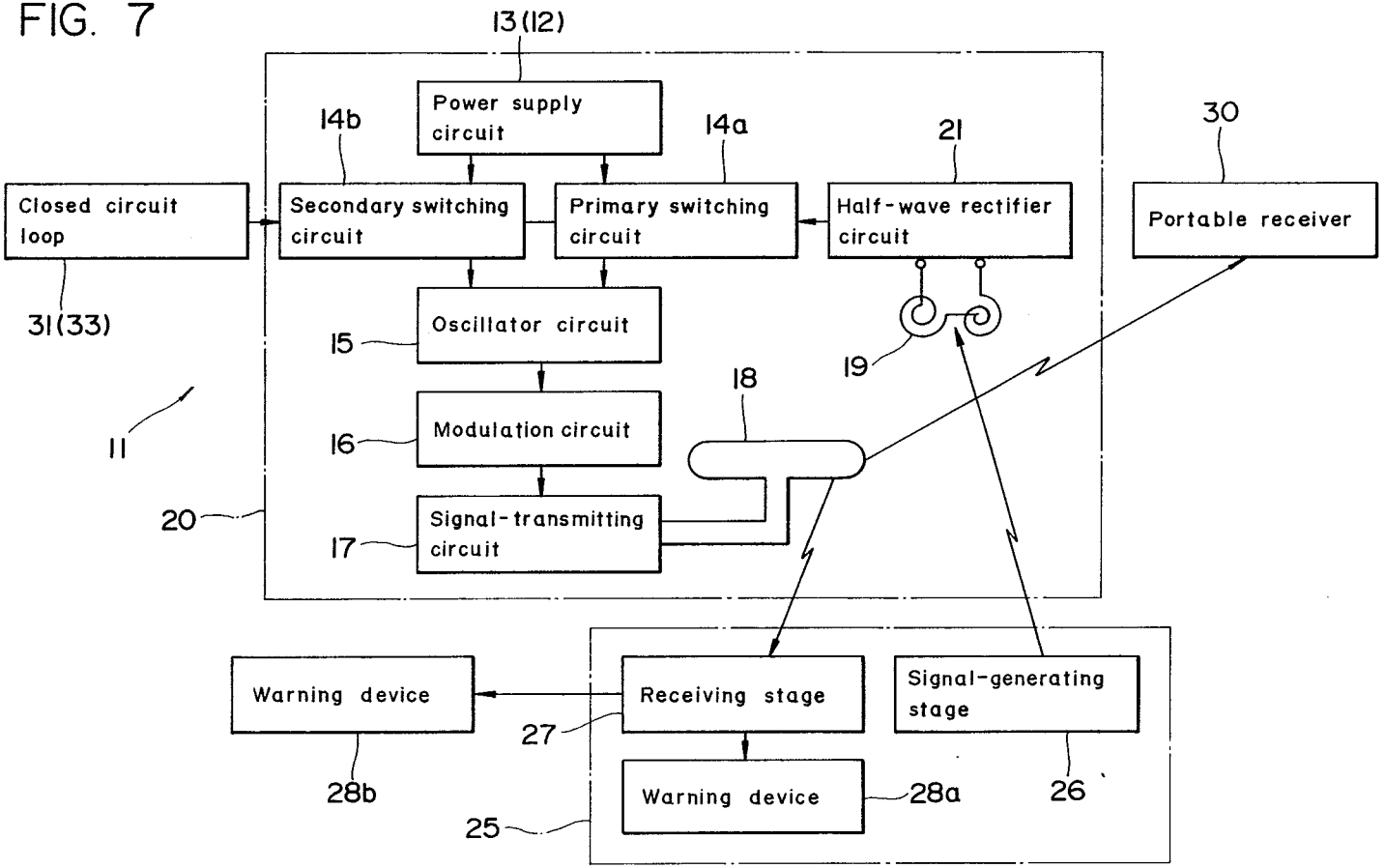
FIG. 7 is a block diagram of the second embodiment of this invention.
Figure 9:
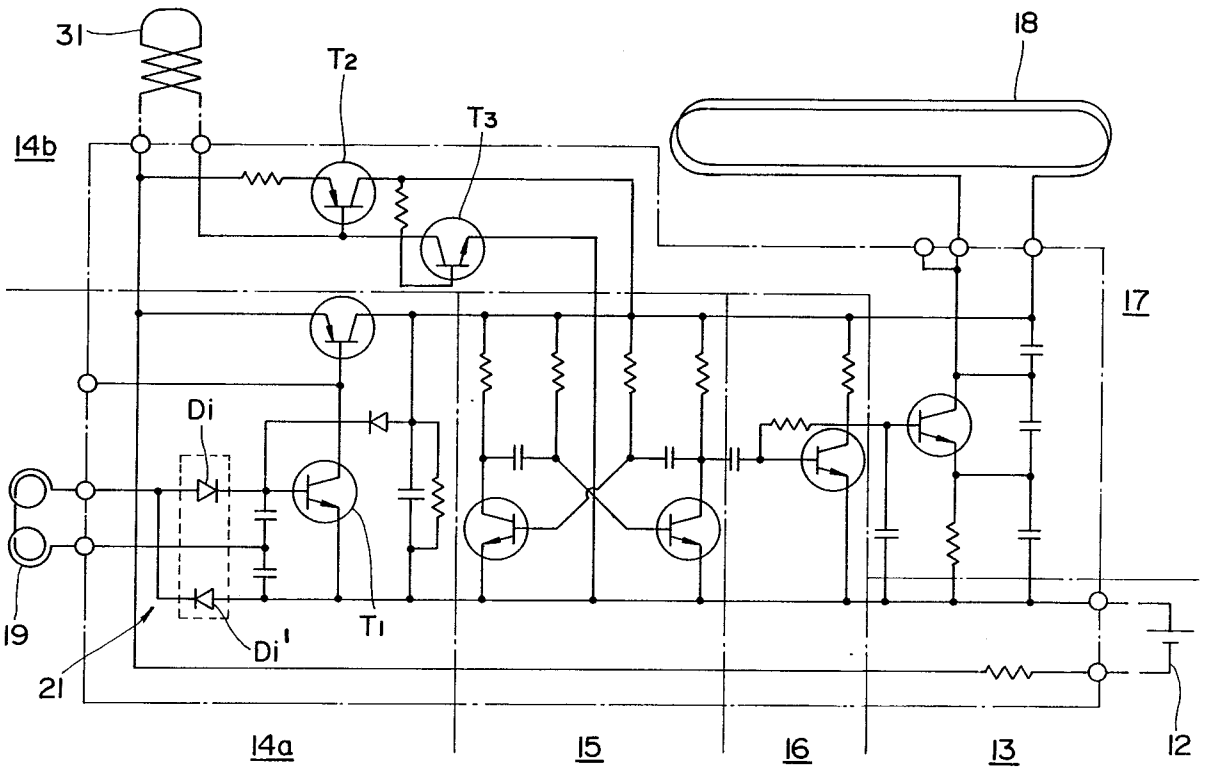
FIG. 9 is a circuit diagram of the same signal generator.

FIGS. 7–9 show another version of the signal generator 11 embodying the invention and made so that the receiver cannot be removed from the merchandise M. The following deals with those parts that are different from the first embodiment of the invention described above.

As shown in FIG. 9, the signal generator 11 energizes the power supply circuit 13 when receiving the weak radiowave energy from detector gate 25. Two types of switching circuits are mounted in parallel. One is the first or primary switching circuit **14*a* maintaining the power supply circuit in the switched-on condition while receiving the power supplied from the power supply circuit 13 as a result of this switching-on action; the other one is the secondary switching circuit 14*b* maintaining said power supply circuit 13 in the switched-on condition by releasing the corresponding closed circuit loop 31, including the attachment string 33 comprising the closed circuit loop 31 consisting of a part of the circuit lead wire protruding from the body of the unit 20 to form the stage attached to the merchandise M. As a result of the energizing action of primary and secondary switching circuits 14*a* or 14*b*, the oscillator circuit 15 generating the prescribed frequency, the modulation circuit 16 modulating said oscillation frequency to obtain radiowaves of the prescribed frequency, the signal-transmitting circuit 17 for the wireless transmission of the modulated signal and the transmitter antenna 18 are accommodated in body 20**.

Said secondary switching circuit **14*b* includes transistors T2 and T3 whereby the emitter input circuit of this transistor T2 is comprised of said closed circuit loop 31**.

The signal generator 11 of the structure described above is designed so that in the event that a theft has occurred and the attachment string 33 is cut to remove the signal generator 11 from the merchandise M in an attempt to bypass the detector gate 25 for said signal generator 11, the secondary switching circuit **14*b* will be released as a result of the string's being cut since said attachment string 33 acts as the closed circuit for the secondary switching circuit 14*b*. This therefore results in transistor T3 being deenergized and a radiowave of the prescribed frequency being generated from the transmitter antenna 18 under the action of the built-in miniature battery 12 via oscillator circuit 15, modulation circuit 16, and signal-transmitting circuit 17**.

This radiowave signal output will therefore be received by the receiving stage 27 of detector gate 25 and cause warning devices **28*a* and 28*b* to generate an acoustic alarm or a flash-light alarm to warn that a shoplifting incident has taken place. It will in this case also be possible to identify the thief by the BOO tone generated on approaching the portable receiver 30 when said portable receiver 30 picks up the radiowave signal from the signal generator 11**.

Moreover, a preferred form of the configuration described above is for the attachment string 33 protruding from the body 20 of the signal generator 11 to be comprised of an electrically conductive opening/closing stage, for example, hook 32, for mounting to the loop-shaped part. Said radiowave atmosphere need not only consist of one particular frequency but may also consist of variable frequencies.

While in the foregoing preferred embodiments of this invention have been disclosed for purposes of illustration it is evident that many variations and variants can be conceived that are capable of attaining the purpose and scope of this inventions and of producing the same effect. This invention shall therefore include all of these variations and variants falling under the scope of this invention.

What we claim is:

1. An anti-shoplifting system for identifying unauthorized removal of individual goods sold in shops by generating a theft-detection alarm and being capable of identifying the shoplifter, said system comprising:

a detector means mounted in the vicinity of each entrance and exit of the shop, said detector means having a signal-generating stage for generating a radiowave having a predetermined range, a signal-receiving stage for receiving a specific frequency, and a warning device for providing a warning signal upon receipt of said specific frequency;

a signal generator unit, being attached to individual goods sold in the shop, for generating said specific frequency when said signal generator unit is within said predetermined range of said detector means, said signal generator unit including a parallel wound coil, being a conductive wire wound at least once to form several interconnected coils to obtain a parallel array of coils, said parallel wound coil for receiving said generated radiowave from said signal-generating stage and for producing a magnetic field current;

a switching circuit receiving said magnetic field current and for producing an "energized" signal;

a flat miniature power pack receiving said "energized" signal and upon receipt of said "energized" signal being maintained in a switched-on condition for supplying power to said signal generator unit;

an oscillation-modulation circuit for generating a radiowave of said specific frequency; and a signal-transmitting circuit for transmitting said generated radiowave from said oscillation-modulation circuit.

2. Anti-shoplifting system of claim 1 wherein said switching circuit is a double switching circuit having a primary switching circuit for energizing the flat miniature power pack while receiving said generated radiowave, and a secondary switching circuit for driving the oscillator and having an attachment string, protruding from said signal generator unit and attached to individual goods, for energizing said power pack and for maintaining said power pack in said switched-on condition when said attachment string has been separated from the individual goods.

3. Anti-shoplifting system of claim 2 wherein said attachment string is a breakable flexible conductive wire.

4. Anti-shoplifting system of claim 3 wherein said attachment string can be readily attached and detached to or from the signal generator unit.

* * * * *